United States Patent [19]

Hashiguchi et al.

[11] Patent Number: 5,076,549

[45] Date of Patent: Dec. 31, 1991

[54] CONTINUOUS DIP-PLATING APPARATUS FOR STEEL STRIP

[75] Inventors: Koichi Hashiguchi; Koji Yamato; Junji Kawabe, all of Chiba; Ichiro Tanokuchi, Okayama, all of Japan

[73] Assignee: Kawasaki Steel Corporation, Kobe, Japan

[21] Appl. No.: 557,615

[22] Filed: Jul. 24, 1990

[30] Foreign Application Priority Data

Aug. 2, 1989 [JP] Japan ..... 1-199452

[51] Int. Cl.[5] ..... C21B 9/64

[52] U.S. Cl. ..... 266/107; 266/249

[58] Field of Search ..... 266/107, 249, 103, 112, 266/111, 120, 130, 133

[56] References Cited

U.S. PATENT DOCUMENTS 3,010,844 11/1961 Klein et al. ..... 266/107

3,669,761 6/1972 Schulze et al. ..... 266/107

FOREIGN PATENT DOCUMENTS 0041312 9/1987 Japan ..... 266/107

OTHER PUBLICATIONS

Japanese Publication No. 2-190464 1-89.

*Primary Examiner*—S. Kastler

*Attorney, Agent, or Firm*—Dvorak & Traub

[57] ABSTRACT

A continuous dip-plating apparatus for a steel strip has a pot containing a metal melt which forms a plating bath, a device for causing the steel strip to run through the plating bath such that the steel strip makes a turn around a sink roll in the plating bath so as to be pulled upwardly above the surface of the plating bath, and a wiping device disposed above the pot and adapted for adjusting the amount of deposition of the metal melt to the steel strip. The apparatus further has a pair of flow regulating plates for suppressing deposition of dross to the steel strip. The flow regulating plates are arranged in parallel with and in the vicinity of the portion of the steel strip running upwardly through the plating bath with the upper ends of the flow regulating plates being disposed substantially at the same level as the plating bath. Preferably, the height of the portion of each flow regulating plate below the level of the surface of the plating bath is not smaller than 50 mm, while the distance between each flow regulating plate and the steel strip is preferably not greater than 80 mm. It is also preferred that the upper end of each flow regulating plate is positioned between a level which is 10 mm below the surface of the plating bath and a level which is 50 mm above the surface of the plating bath.

4 Claims, 3 Drawing Sheets

CONTINUOUS DIP-PLATING APPARATUS FOR STEEL STRIP

BACKGROUND OF THE INVENTION

1. Field of the Invention

The present invention relates to a dip-plating apparatus for steel strips or sheets, such as a Zn hot-dip plating of steel sheets, capable of remarkably improving the appearance of the plated surfaces.

2. Description of the Related Arts

In recent years, dip-plated steel strips or sheets are finding increasing use, both in fields and quantity, as is the case of application of alloyed Zn hot-dip plated steel sheets to outer panels of automobiles, as well as application of Al dip-plated steel sheets to various automotive parts. Consequently, requirements for higher quality of dip-plated steel strips or sheets are becoming more severe.

One of the critical requisites for the product quality is that the dip-plated surfaces of steel strips or sheets have an attractive appearance. In case of a zinc hot-dip plating, minute defects such as pimples are often observed in the plated surfaces of the plated steel sheets. Such defects undesirably impair the appearance of the plated sheets and, when the sheets are worked by, for example, a press subsequently to the plating, these defects are amplified to seriously degrade the appearance of the product after the work.

These defects are attributable to trapping of foreign matters in the plating layer, e.g., trapping of zinc oxides, Fe-Zn alloys and Fe-Al alloys contained in or floating on the surface of the plating bath in case of Zn hot-dip plating. These matters are generally referred to as "dross" hereinafter.

Hitherto, various methods and apparatus have been proposed for the purpose of eliminating defects due to trapping of dross. For instance, Japanese Unexamined Patent Publication No. 57-203764 discloses an art in which generation of oxide-type dross is suppressed by a seal box which surrounds the portion of a steel strip rising from the plating bath so as to control the oxygen concentration in the region around the rising portion of the steel strip.

On the other hand, a method has been proposed in, for example, Japanese Unexamined Patent Publication No. 62-202070, in which floating dross is removed by filtering or floatation.

The method proposed in Japanese Unexamined Patent Publication No. 57-203764, however, cannot produce any appreciable effect in removing influences produced by dross floating on the bath such as Fe-Al and Fe-Zn alloys, although it effectively suppresses generation of oxide-type dross.

The apparatus shown in Japanese Unexamined Patent Publication No. 62-202070 often suffers from clogging of filters, with the result that the operation becomes unstable. In addition, this art cannot produce any effect against floating dross.

SUMMARY OF THE INVENTION

Accordingly, an object of the present invention is to provide a continuous dip-plating apparatus for steel strips capable of overcoming the above-described problems of the prior art.

To this end, according to the present invention, there is provided a continuous dip-plating apparatus for a steel strip, comprising: a pot containing a metal melt which forms a plating bath; means for causing the steel strip to run through the plating bath such that the steel strip makes a turn around a sink roll in the plating bath so as to be pulled upward to the outside of the plating bath; wiping means disposed above the tank and adapted for adjusting the coating weight of the metal melt on the steel strip; and a pair of flow regulating plates each having a width greater than that of the steel strip. The flow regulating plates are arranged in parallel with and in the vicinity of the portion of the steel strip running upwardly through the plating bath such that the upper ends of the flow regulating plates are disposed substantially at the same level as the plating bath.

The term "flow regulating plate" is used to mean a plate which forms a laminar flow in the region between itself and the opposing surface of the steel strip such that a large gradient of flow velocity is developed between itself and the steel strip, thereby to suppress deposition of dross to the steel strip.

The height of the portion of the flow regulating plate below the plating bath of metal melt is preferably 80 mm or greater. The distance between the flow regulating plate and the steel strip is preferably 80 mm or smaller. It is also preferred that the top end of the flow regulating plate is positioned between a level which is 10 mm below the surface of the bath and a level which is 50 mm above the surface of the bath.

According to the present invention, deposition of the dross is effectively suppressed by the provision of the flow regulating plate. This remarkable effect is considered to be attributable to the following reasons.

Forces acting on particles in a fluid are subject to the principles of fluid dynamics. In general, a particle in a fluid with a velocity gradient receives a force which is proportional to the velocity gradient and which acts to urge the particle to the end of lower velocity. This could be compared with the case of a leaf floating on a stream, which tends to be drifted from the center of the stream where the velocity is high to a shore side where the water stagnates.

The above and other objects, features and advantages of the invention will become clear from the following description of the preferred embodiments when the same is read in conjunction with the accompanying drawings.

DESCRIPTION OF THE PREFERRED EMBODIMENTS

Before commencing the description of embodiments, an explanation will be given of the principle of the present invention.

Figure 2:
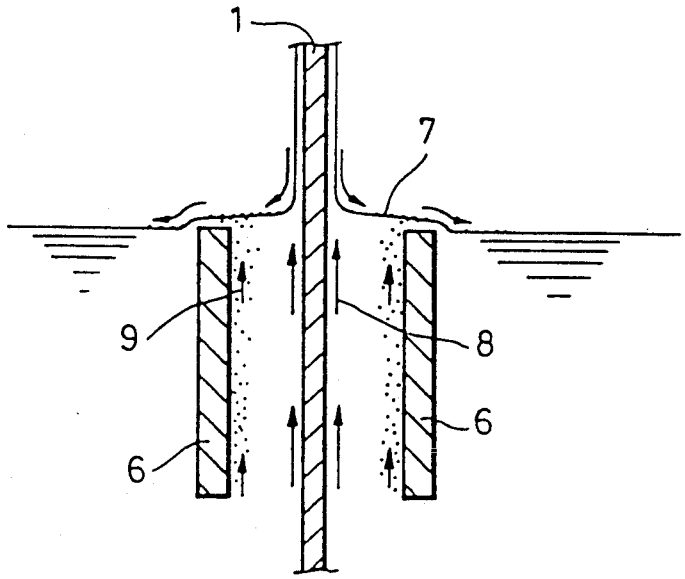
FIG. 2 is an illustration of the operation of the apparatus of the present invention.

Referring to FIG. 2, laminar flow of metal melt is formed in the region between each flow regulating plate 6 and the adjacent surface of the steel strip 1 which is being plated. In this region, the metal melt adjacent the surface of the steel strip 1 accompanies the surface of the metal strip 1 so as to exhibit a high velocity 8, while the metal melt adjacent the surface of the flow regulating plate exhibits a flow velocity 9 which is substantially zero, whereby a large flow velocity gradient is developed in this small region. It will be understood that this velocity gradient is much greater than that obtained when the flow regulating plates 6 are not provided. For the fluid-dynamic reason explained before, the dross 7 accompanying the steel strip is urged away from the steel strip 1, i.e., towards each flow regulating plate 6, and is discharged to the melt of the bath over the upper ends of the flow regulating plates 6.

The metal melt of the bath is brought upward by the upwardly moving steel strip from the inside of the bath into the restricted space defined by the flow regulating plates 6. At the same time, part of the molten metal accompanying the steel strip is wiped off the strip for the purpose of adjustment of the plating thickness, and falls back into the above-mentioned restricted space. Thus, portions of molten metal coming into the restricted space from the upper and lower sides flow over the upper ends of the flow regulating plates. Thus, the flow regulating pates 6 also serve as a dam over which the metal melt flows to the outside of the above-mentioned restricted space so as to keep any dross 7 on the plating bath away from the metal strip 1.

Thus, deposition of dross to the steel strip is effectively suppressed by the provision of the flow regulating plates.

An embodiment of the present invention will be described with reference to the drawings.

Figure 1:
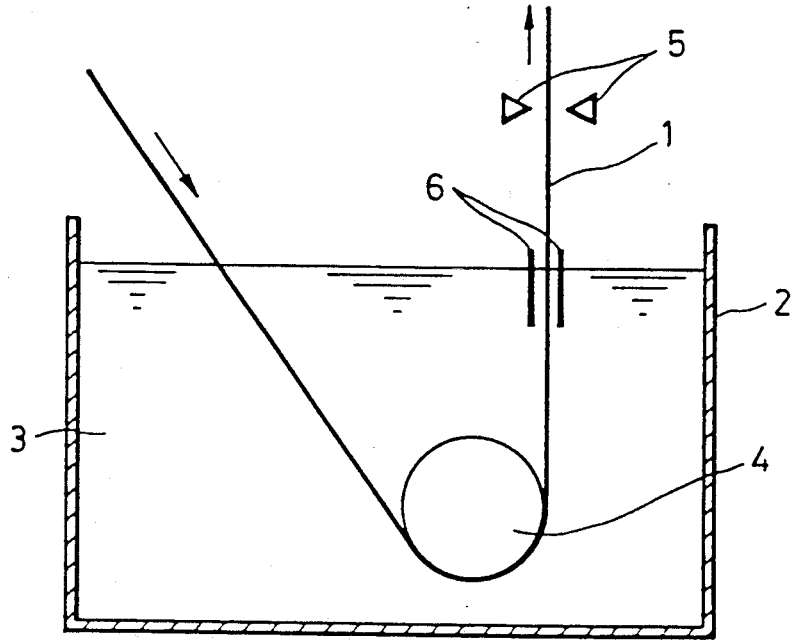
FIG. 1 is a schematic illustration of an embodiment of the apparatus of the present invention.

Referring to FIG. 1, a steel strip 1 continuously runs through a bath of a metal melt contained in a pot 2 and, after making a turn around a sink roll 4 in the bath 3, continuously pulled upward and is suitably taken up for an adjustment of coating weight of the metal melt through a wiping means 5 provided above the pot 1 containing the metal melt.

A pair of flow regulating plates 6, each having a width greater than that of the steel strip 1, are disposed in parallel with the upwardly running portion of the steel strip 1 in the bath 3 of the metal melt, leaving predetermined gaps between both plates 6 and adjacent surfaces of the steel strip 1. The upper ends of the flow regulating plates 6 are held substantially at the same level as the surface of the bath of the metal melt. The flow regulating pates 6 are made of a suitable durable material such as a steel, ceramic or the like.

Figure 3:
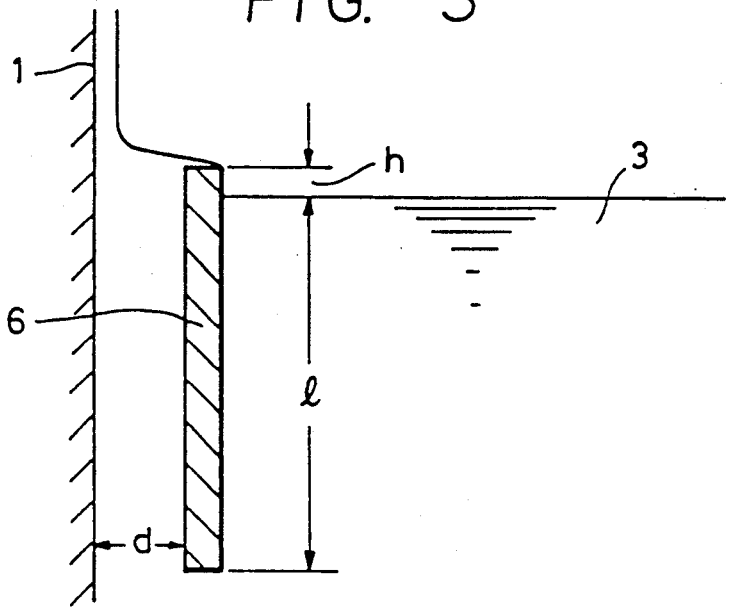
FIG. 3 is an illustration of dimensions of the flow regulating plates used in the invention.

In order to confirm the effect of provision of the flow regulating plates for suppressing deposition of dross to the plated steel strip, a test was conducted in a continuous Zn hot-dip galvanizing line. The test was conducted by employing steel plates of 15 mm thickness as the flow regulating plates 6, while varying the dimensions shown in FIG. 3, i.e., the distance d between the steel strip 1 and each flow regulating plate 6, the height l of the portion of the flow regulating plate below the surface of the metal melt forming the plating bath, and the height or level h of the upper end of the flow regulating plate above the metal melt, so as to investigate the influences of these factors. The steel strip was made to run at a velocity of 80 m/min, and the coating weight of the plating metal was adjusted to 60 g/m$^2$.

Figure 4:
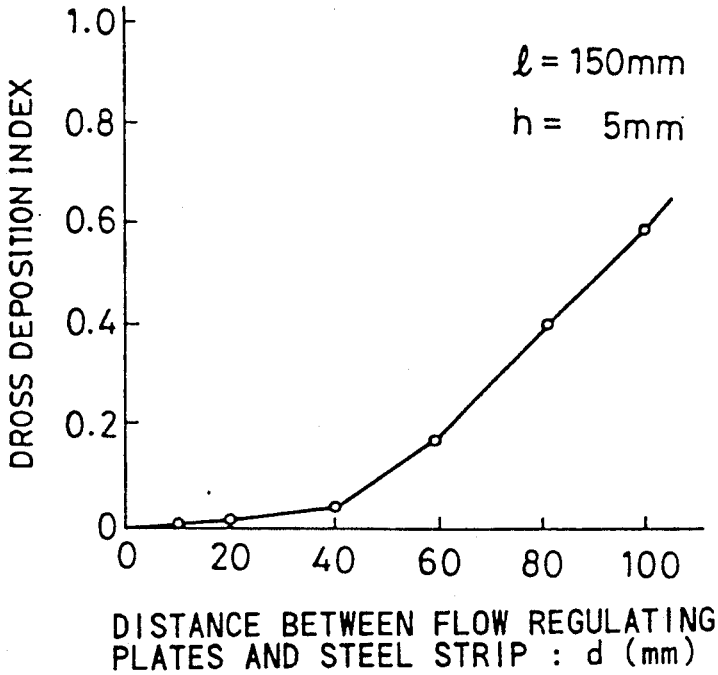
FIG. 4 is a graph showing the influence of the distance d between a steel strip and a flow regulating plate on the amount of dross deposited to the steel strip.
Figure 5:
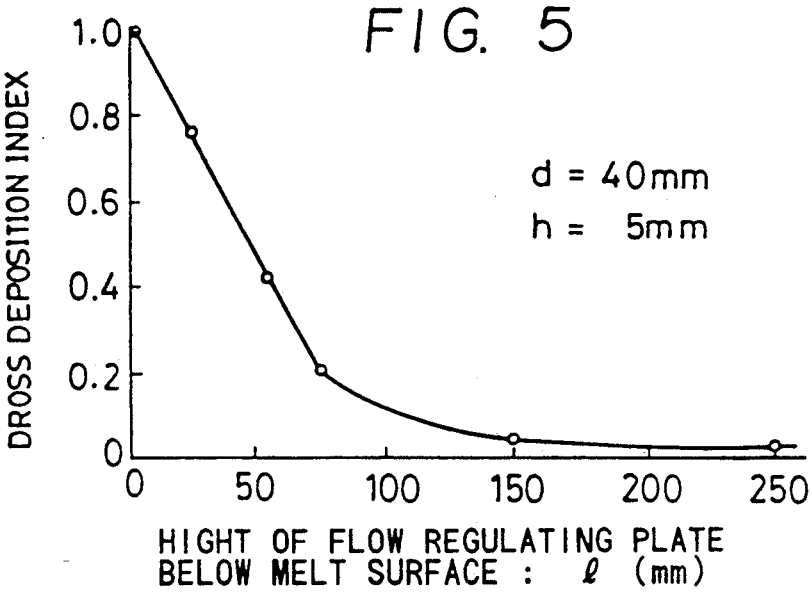
FIG. 5 is a graph showing the influence of the height l of the portion of the flow regulating plate under the surface of the melt which forms a plating bath on the amount of dross deposited to the steel strip.
Figure 6:
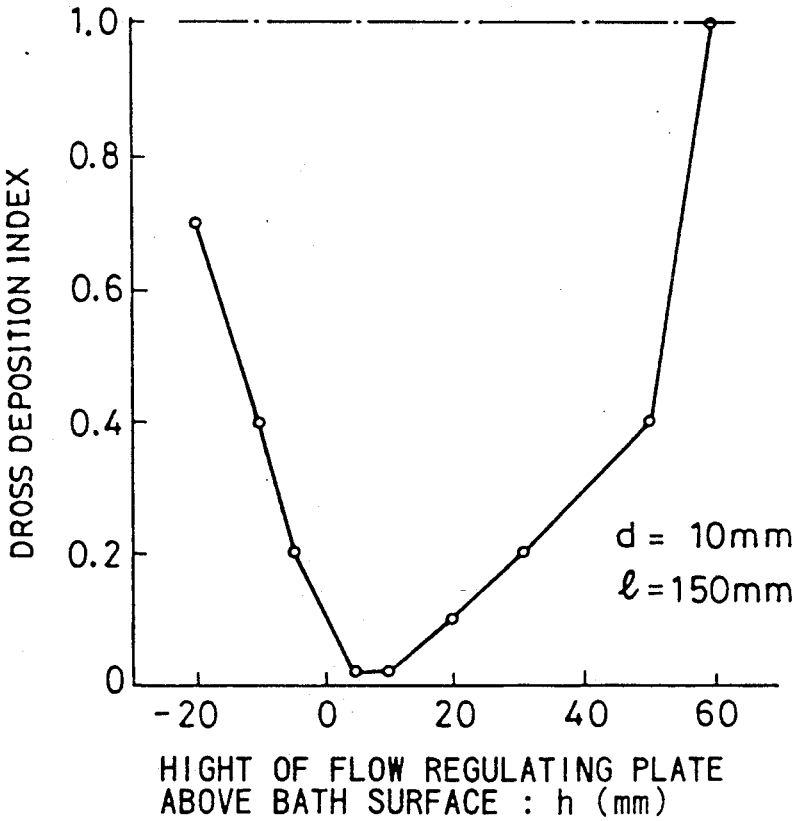
FIG. 6 is a graph showing the influence of the height h of the portion of the flow regulating plate above the melt surface on the amount of dross deposited to the steel strip.

The test results are shown in FIGS. 4, 5 and 6. In these Figures, the term "dross deposition index" means the ratio (amount of dross deposited to strip in the presence of flow regulating plates)/(amount of dross deposited to strip in the absence of flow regulating plates).

From FIGS. 4, 5 and 6, it will be seen that the deposition of dross is effectively suppressed by the provision of the flow regulating plates 6, and the effect produced by the flow regulating plate is more remarkable when the distance d between the flow regulating pate and the steel strip is smaller and when the height l of the portion of the flow regulating plates below the melt surface is greater. It was also confirmed that a greater effect is obtained when the flow regulating plates are arranged to project above the melt surface. No substantial effect is produced when the height l of the portion of the flow regulating plates below the melt surface is small. In order to obtain an appreciable effect, it is necessary that the height l is 50 mm at the smallest It is most preferred that the flow regulating plates 6 are arranged such that their upper ends are positioned between 0 and 20 mm above the melt surface, but the advantage of the present invention is still obtainable when the upper ends of the flow regulating plates are above a level which is 10 mm below the melt surface. In this embodiment, the height h of the upper ends of the flow regulating plates above the melt surface should be not greater than about 30 mm, but the advantage of the invention can be obtained when the conditions are set so as to enable the metal melt in the region between the steel strip and the flow regulating plates to flow over the flow regulating plates. Results achieved in this method vary depending on the running velocity of the steel strip, and the upper limit of the height h increases as the velocity of the strip increases. Taking into account cases where the steel strips are plated at high running velocities, the upper limit of the height h is determined to be 50 mm.

Although Zn hot-dip plating has been specifically mentioned, it is to be understood that the present invention can be applied also to dip-plating with various other metals such as Al.

As has been described, according to the present invention, it is possible to effectively suppress deposition of dross to steel strip which is being dip-plated, thus offering a more attractive appearance of the plated steel strips over known methods.

What is claimed is:

1. A continuous dip-plating apparatus for a steel strip, comprising:

a pot containing a metal melt which forms a plating bath;

means for causing said steel strip to run through said plating bath such that said steel strip makes a turn around a sink roll in said plating bath so as to be pulled upwardly above the surface of said plating bath;

wiping means disposed above said pot and adapted for adjusting the coating weight of said metal melt to said steel strip; and a pair of flow regulating plates each having a width greater than that of said steel strip, said flow regulating plates being arranged in parallel with and in the vicinity of the portion of said steel strip running upwardly through said plating bath, with the upper ends of said flow regulating plates being disposed substantially at the same level as said plating bath.

2. A continuous dip-plating apparatus for a steel strip according to claim 1, wherein the height of the portion of each flow regulating plate below the level of the surface of said plating bath is not smaller than 50 mm.

3. A continuous dip-plating apparatus for a steel strip according to claim 1, wherein the distance between each flow regulating plate and said steel strip is not greater than 80 mm.

4. A continuous dip-plating apparatus for a steel strip according to claim 1, wherein the upper end of each flow regulating plate is positioned between a level which is 10 mm below the surface of said plating bath and a level which is 50 mm above the surface of the plating bath.

* * * * *